United States Patent [19]

Sipos et al.

[11] Patent Number: 4,793,410

[45] Date of Patent: Dec. 27, 1988

[54] LOAD DETECTION AND INDICATOR APPARATUS FOR WELL TUBING OR THE LIKE

[75] Inventors: David L. Sipos; Duane M. Kuske; Paul D. White, Jr., all of Houston, Tex.

[73] Assignee: Bowen Tools, Inc., Houston, Tex.

[21] Appl. No.: 205,824

[22] Filed: Jun. 13, 1988

[51] Int. Cl.[4] ..... E21B 19/08

[52] U.S. Cl. ..... 166/77; 73/862.58; 166/113; 166/250; 166/385; 177/208

[58] Field of Search ..... 166/77, 113, 250, 385; 73/862.58, 151; 177/208, 209, 254

[56] References Cited

U.S. PATENT DOCUMENTS

| | | | |
|---|---|---|---|
| 3,285,485 | 11/1966 | Slator | 166/77 X |
| 4,133,206 | 1/1979 | Hida et al. | 73/862.58 X |
| 4,450,906 | 5/1984 | Firmin | 166/113 |
| 4,676,312 | 6/1987 | Mosing et al. | 166/77 |

*Primary Examiner*—Hoang C. Dang

*Attorney, Agent, or Firm*—Pravel, Gambrell, Hewitt, Kimball & Krieger

[57] ABSTRACT

A load cell apparatus especially suitable for detecting and indicating loads on tubing injected into or withdrawn out of a well with an injector apparatus. The load cell apparatus is located longitudinally directly below the injector apparatus to avoid angling of the tubing as it is run into, or pulled out of, a well. Two gauges are provided to independently indicate positive and negative loads on the tubing and to facilitate determining whether the pipe has hit an obstruction in a well.

12 Claims, 7 Drawing Sheets

LOAD DETECTION AND INDICATOR APPARATUS FOR WELL TUBING OR THE LIKE

FIELD OF THE INVENTION

The field of this invention is apparatus for detecting and indicating the amounts of loads or forces on objects such as well tubing supported by apparatus for moving the tubing into and/or out of a well.

BACKGROUND OF THE INVENTION

For a number of years, well tubing has been injected and removed from wells for performing various operations. Examples of apparatus for that purpose are shown in U.S. Pat. Nos. 3,285,485; 3,313,346; 3,658,270; 3,675,719; 3,690,136; 3,690,381; 3,722,589; 3,722,594; and 3,791,447. U.S. Pat. No. 3,285,485 shows an apparatus wherein the well tubing is lowered and raised through a vertically aligned two-gauge means for detecting and indicating loads or forces on the well tubing in both upward and downward directions. It has been common practice in more recent years to provide a pivoted mounting of such equipment in conjunction with a load cell for detecting and indicating the compressive loading or forces on the pipe in the downward direction only, an illustration of which is shown in FIG. 1 of the drawings, as will be more fully explained.

SUMMARY OF THE INVENTION

This invention relates to a new and improved apparatus for detecting and indicating loads on elongate objects such as well tubing or the like which moves relative to the apparatus.

More specifically, the apparatus is a load cell which is disposed concentrically below a well tubing injector apparatus with guide means to restrict angular deviation of the well tubing from the well axis and kinking of the well tubing in the event of a buckling load. The load cell has means for providing neutral buoyancy to the injector apparatus and for measuring either positive or negative loads on the injector apparatus relative to such neutral buoyancy position. The positive and negative measuring mechanisms are separated and arranged to ensure no lost motion during cross-over from positive to negative loads, or vice versa, and to also obtain independent operation of each of two gauges to assure accurate gauge readings for both positive and negative loads.

DESCRIPTION OF THE PREFERRED EMBODIMENT

Figure 1:
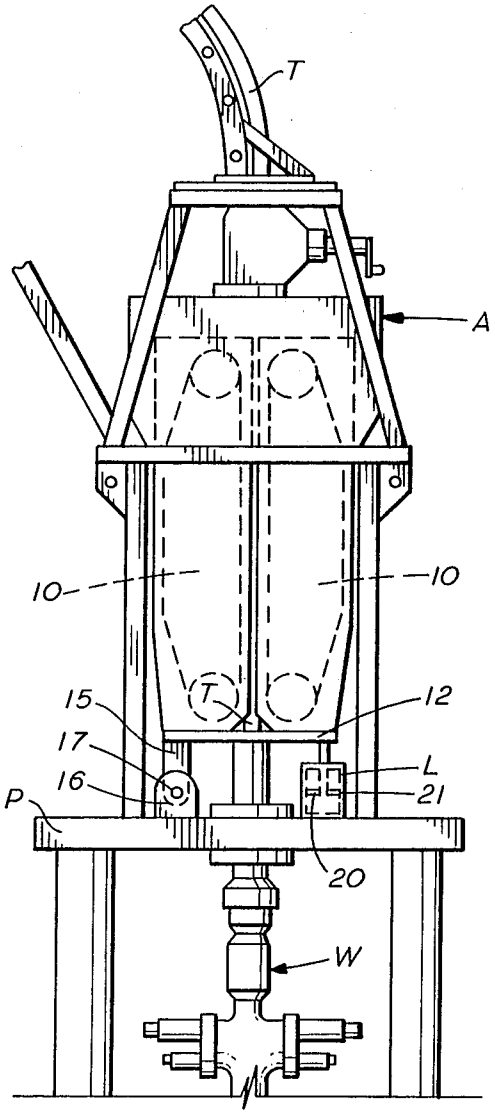
FIG. 1 (PRIOR ART)
FIG. 1 is an elevation which generally illustrates a typical prior art injector apparatus with a prior art load cell arrangement.

In the drawings, the letter A designates generally the injector apparatus which is only schematically illustrated. A detailed example of an injector apparatus is disclosed in U.S. Pat. No. 3,285,485. Briefly, the injector apparatus A is adapted to feed or inject a tubing or pipe T between two endless drive chains 10 for the purpose of feeding or withdrawing the tubing T into or out of a well through wellhead equipment W at the upper end of the well. The typical wellhead equipment W illustrated schematically in the drawings includes blowout preventers and other controls which form no part of the present invention. The prior art apparatus shown in FIG. 1 is not shown in any patent so far as is known, but it is typical of the load cell apparatus used with well tubing in recent years. Considering the illustration of such prior art apparatus in FIG. 1, as shown schematically, the injector apparatus A has a pair of endless chain drive assemblies 10 mounted on a base 12. The base 12 is pivotally mounted to the well platform P by a pivoted arrangement which is schematically shown as a downwardly extending pivot member 15 which is pivotally connected to an upstanding pivot member 16 mounted on the platform P, with a pivot pin 17 providing for the pivoting movement of the member 15 relative to the member 16. The member 15 is welded or is otherwise secured to the base 12 so that the central portion o the apparatus A can pivot or move about the pivot pin 17.

On the other side of the base 12 from the pivot, a conventional load cell L has been used in the past. Such load cell is schematically shown in FIG. 1 as having a piston 20 in a closed chamber 21, which has fluid below the piston 20. In the typical use of the apparatus A, the tubing T has been forced into a well through the well equipment W, where the well is under pressure so that it requires a pushing force downwardly on the tubing T to force it into the well. This is particularly true where the lower end of the tubing T has a check valve closing off the lower end of the tubing T, which is a typical way in which the tubing T is injected into a well. In the past, with the prior art arrangement of FIG. 1, the force or load on the tubing T has been measured with the load cell L by the chain drive assemblies 10 of the apparatus A tilting about the pivot pin 17 in a clockwise direction as viewed in FIG. 1. Such movement imparted a compressive force to the liquid in the chamber 21 below the piston 20 which was responsive to the amount of force or load on the tubing T. That force was indicated on a typical conventional gauge.

Figure 2:
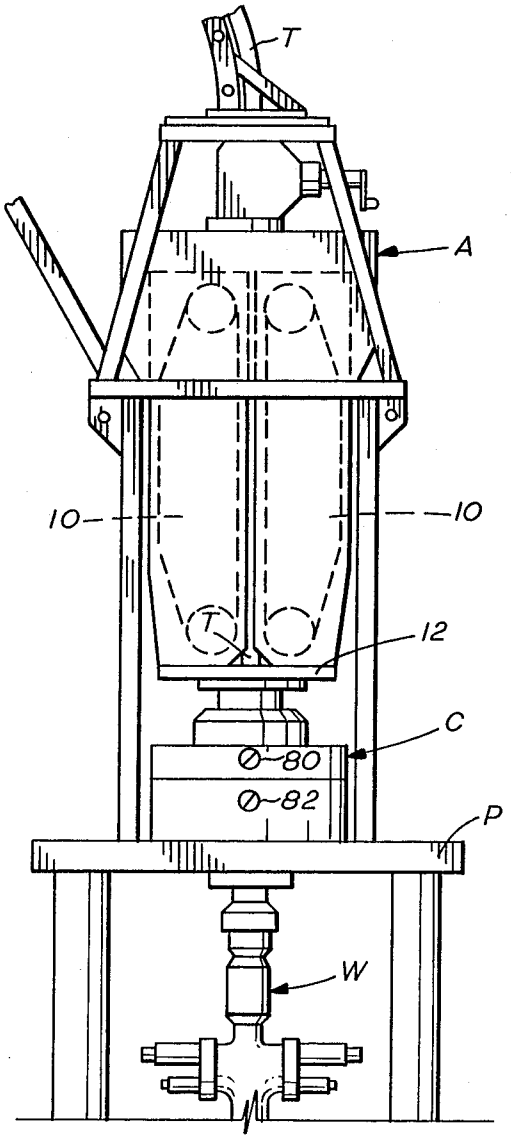
FIG. 2 is an elevation which generally illustrates the present invention showing the load cell apparatus for injecting or withdrawing tubing from a well.

The present invention is shown schematically in FIG. 2 and in detail in FIGS. 3, 3A, 3B, 4, 4A, and 4B of the drawings. The parts of the apparatus of this invention shown in FIG. 2 which are the same as in FIG. 1 are identified with the same letters and numerals as in FIG. 1. As can be seen in FIG. 2, the injector apparatus A is mounted on a load cell apparatus C which is disposed longitudinally directly below the apparatus A with the longitudinal passage between the endless chain assemblies 10 in alignment with the longitudinal opening through the well equipment W. The base 12, as will be more fully explained, is mounted on the load cell apparatus C so that it does not pivot. Also, the load cell apparatus C is so constructed that readings of the amount of the load on the tubing T in either the downward direction or the upward direction can be obtained without causing inaccuracies in the readings.

Figure 3:
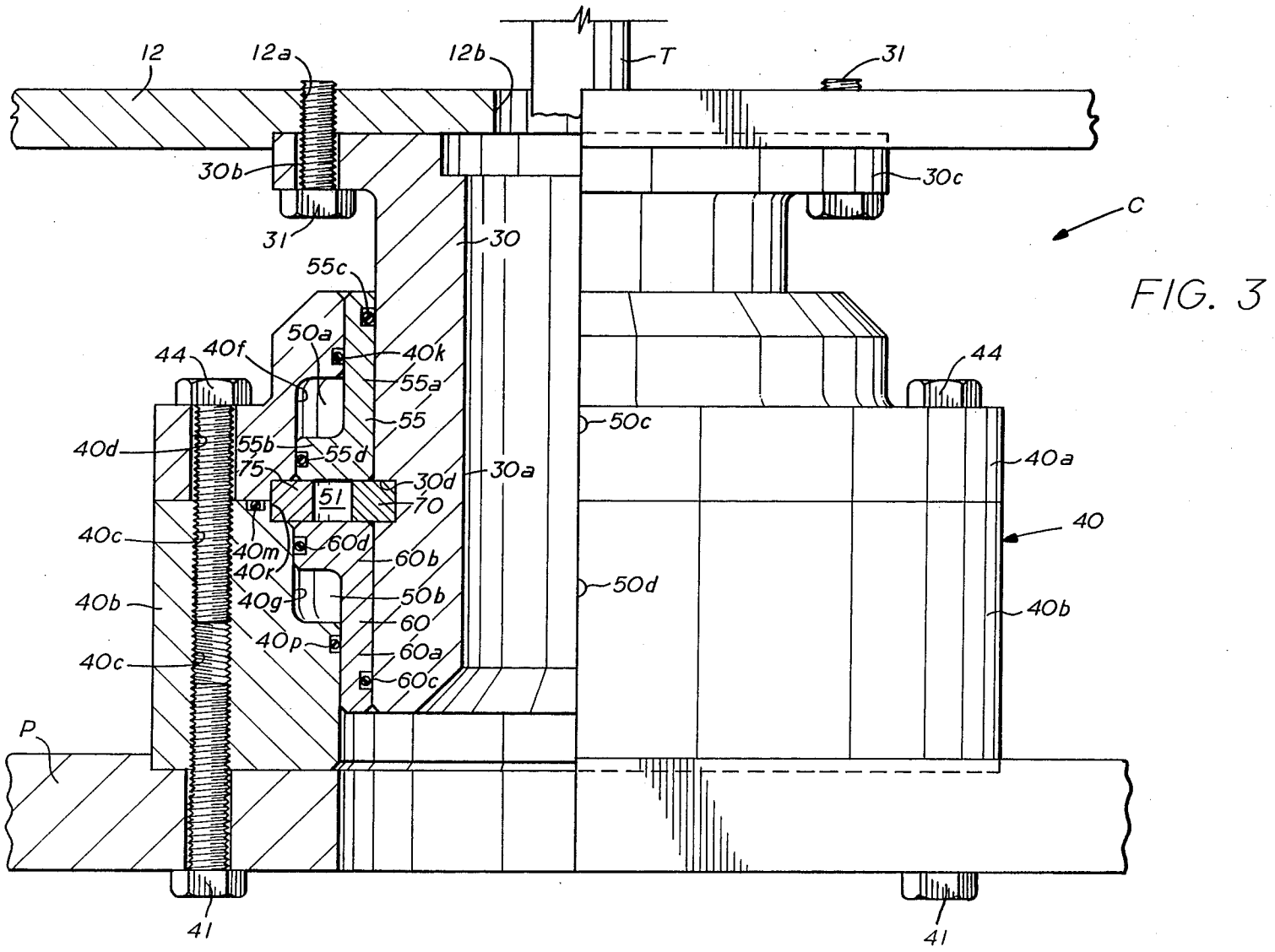
FIG. 3 is a view partly in section and partly in elevation, illustrating one form of the load cell apparatus of this invention prior to any load being applied thereto by the tubing.

The load cell C illustrated in FIG. 2 is shown in detail in FIG. 3, with operating positions shown in FIGS. 3A and 3B as will be explained. In FIG. 3, the load cell apparatus C of this invention is shown positioned between and connected to the base 12 of the apparatus A and the platform P for the well.

The load cell apparatus C has a central tubular guide 30 which has a longitudinal bore or opening **30*a* therethrough, through which the tubing T extends from the apparatus A down into the well therebelow. The tubular guide 30 is connected to the base 12 by any suitable connecting means such as the threaded bolts 31 which extend through openings 30*b* in a flange 30*c*. The holes 30*b* preferably are not threaded, but the base 12 has threaded openings 12*a* into which the bolts 31 are threaded. It is also to be noted that the base 12 has a central opening 12*b* which is in longitudinal alignment with the bore 30*a*** and through which the tubing T extends.

A load cell housing 40 which preferably is made in two sections **40*a* and 40*b* is annular or tubular and is fixed to the platform P. That is accomplished by any suitable means such as by bolts 41 which extend up through the platform P and are in threaded engagement with a threaded opening 40*c* in the lower part 40*b* of the load cell housing 40. The upper part 40*a* of the chamber housing 40 is secured to the lower part 40*b* by means of bolts 44 which extend through holes 40*d* into threaded openings 40*c* in the lower section 40*b* of the housing 40. It will be understood that although two of the bolts 41 and two of the bolts 44** are illustrated, the number of such bolts may be increased.

An annular fluid pressure chamber is provided internally of the load cell housing 40, which is formed by an annular internal recess **40*f* in the upper housing section 40*a* and a similar recess 40*g* in the lower housing 40*b*. The fluid pressure chamber has an upper pressure chamber section 50*a* and a lower fluid pressure section 50*b*. An upper annular piston 55 extends into the upper chamber section 50*a*, and an annular lower piston 60 extends into the annular piston section 50*b*. It is to be noted that the piston 55 is formed with a longitudinal or vertical cylindrical leg 55*a*, and an annular flange 55*b* extending from the leg 55*a* into the chamber 50*a***.

Likewise, the piston 60 is oppositely disposed with respect to the piston 55, but it also has a leg **60*a* and an annular flange 60*b* which extends into the annular chamber 50*b***.

It is to be noted that the annular chamber formed by the annular recesses **40*f* and 40*g* is sealed off by suitable O-rings 40*k*, 40*m*, and 40*p* on the housing 40 as well as O-rings 55*c* on the piston 55 and 60*c* on the piston 60. The liquid which is thus confined in the fluid pressure chamber is sealed off by such seals during the movements of the pistons 55 and 60 as will be explained. The piston 55 also has a seal 55*d* which seals with the wall of the recess 40*f* and the piston 60 has a seal 60*d* which seals with the wall of the recess 40*g***. Although the seals have been described as O-rings, which are well known types of seals made of synthetic rubber, it will be understood that other types of suitable seals may be used.

For transmitting longitudinal movements of the tubular guide 30 to the pistons 55 and 60, a split ring 70 is mounted in an annular recess **30*d* on the exterior of the tubular guide 30. The ring 70 may be termed a force transmitting member or means, and it is preferably split solely for the purpose of assembly into the recess 30*d*. By being split, it can be expanded to a large enough diameter to be slipped off of the external surface of the tubular guide 30** when the apparatus is disassembled.

A stop ring 75 is mounted outwardly from and preferably in direct lateral alignment with the ring 70. The ring 75 is also preferably a split ring which fits into an annular recess **40*r* formed in the upper housing 40*a* and the lower housing 40*b*. An annular space 51 which is a part of the fluid pressure chamber also has liquid in it so that there is fluid above and below the flanges 55*b* and 60*b* of the pistons 55 and 60**, respectively.

The upper annular chamber **50*a* is connected through a port 50*c* to a fluid pressure gauge 80 (FIG. 2). Likewise, the lower fluid pressure chamber 50*b* is connected through a suitable port 50*d* to another fluid pressure gauge 82** (FIG. 2).

Considering now the use of the apparatus of this invention, FIG. 3 shows the load cell apparatus C in a neutral position when the tubing T has no load or force in either an upward or downward direction acting upon it.

When injecting a tubing T into a well with the injector apparatus A, the well may or may not be under pressure. If the well is not under pressure, the weight of the tubing T suspended by the injector apparatus A will initially create a load or downward force on the apparatus A which will move the base 12 in a downward direction. If the well is under pressure, the base 12 will not move in a downward direction until the weight of the tubing has overcome the upward pressure in the well.

Figure 3A:
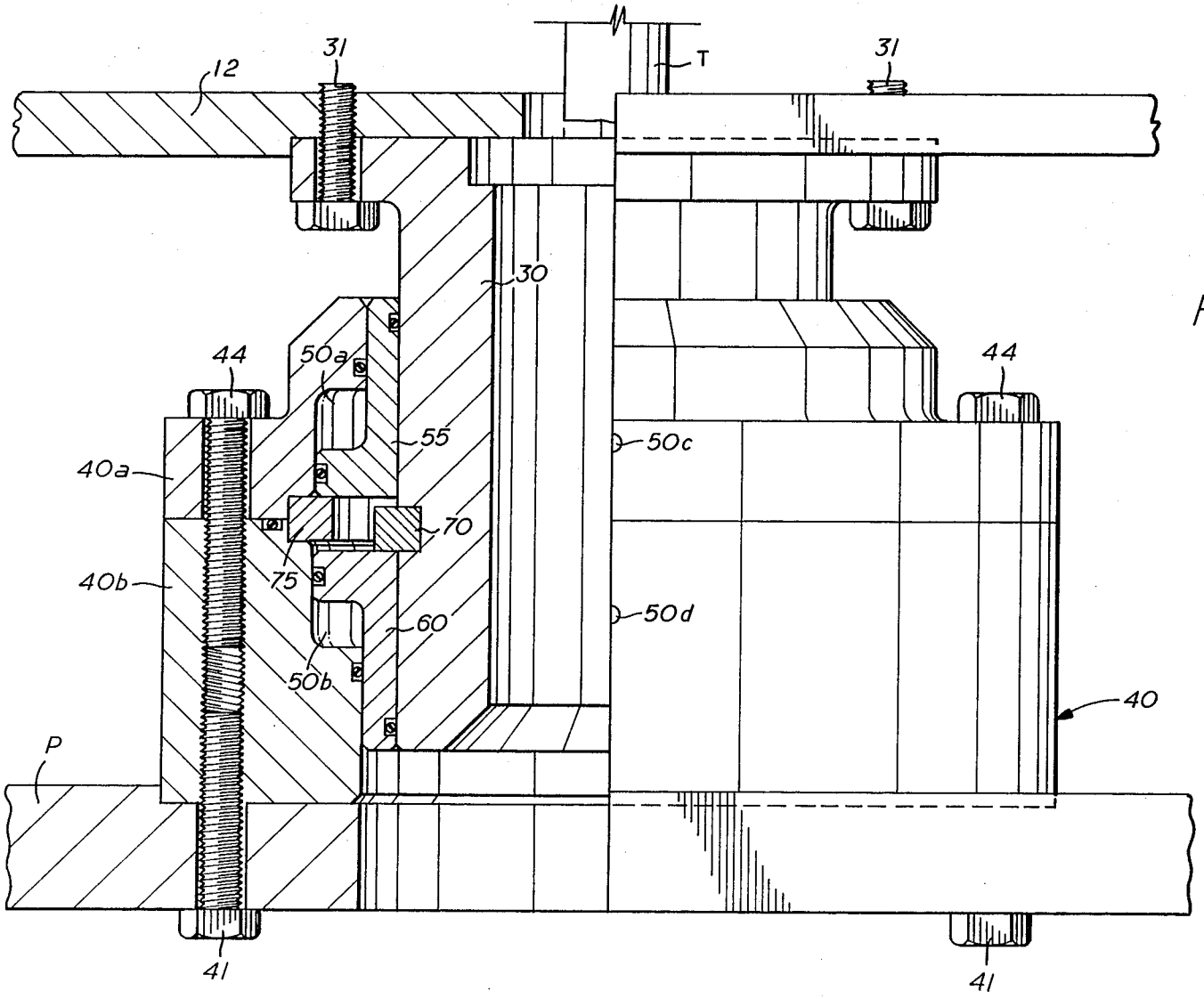
FIG. 3A is a view similar to FIG. 3, but illustrating the apparatus when a load is applied in a downward direction to the load cell apparatus by the tubing which is being introduced into a well by the injector apparatus.

FIG. 3A illustrates a condition in which the tubing T is exerting a downward force or load which is causing the base 12 to move in a downward direction. The downward movement of the base 12 moves the tubular guide 30 downwardly also. The amount of such movement is exaggerated in FIG. 3A for illustration purposes. The actuating member 70 moves downwardly with the guide 30 and imparts a downward movement to the piston 60 for compressing the fluid within the lower fluid pressure chamber **50*b*. The amount of such compression is responsive to the amount of weight or load exerted by the tubing T in a downward direction. The reading of such load is reflected on the gauge 82** (FIG. 2).

Figure 3B:
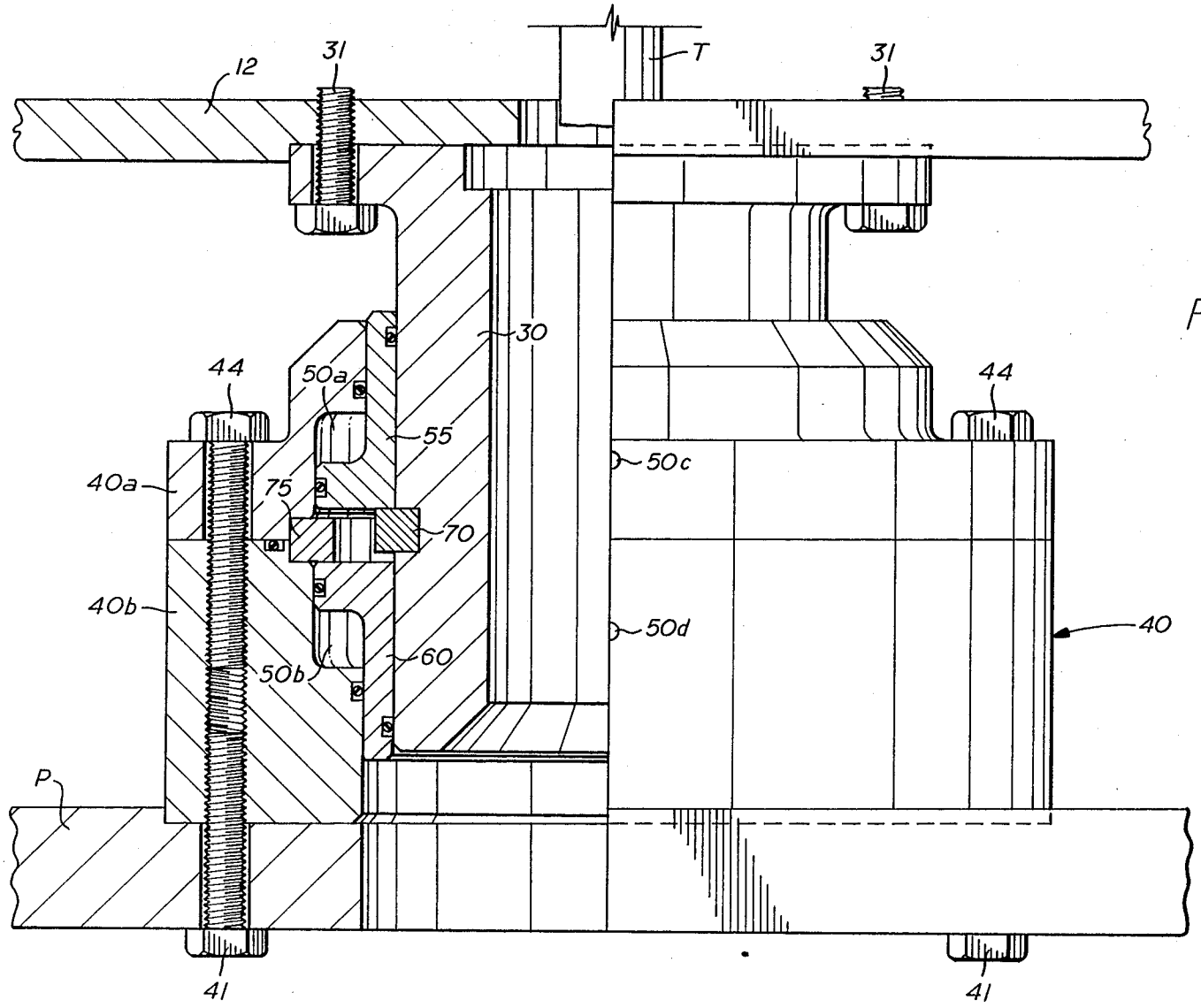
FIG. 3B is a view similar to FIG. 3, but showing the apparatus in a position when there is an upward force or load on the tubing.

FIG. 3B illustrates the relative position of the parts of the apparatus of FIG. 3 when the tubing T is exerting a force in an upward direction. This will occur when the tubing T is being initially inserted into a well under pressure, until such time as the pressure is overcome by the weight of the tubing T which is in the well below the apparatus A. Also, upon the withdrawal of the tubing T from the well, at some point, the tubing T will be exerting an upward force which will cause the base 12 to move in an upward direction as shown in an exaggerated amount in FIG. 3B. Furthermore, in some instances, when the tubing T is being injected into a well, the lower end of the tubing T or some other portion of the tubing T in the well may hit an obstruction which will stop the movement of the tubing T, but the operators at the surface may not be aware that such obstruction has been encountered. However, should such an obstruction occur, the downward load on the tubing will decrease due to the restraint of downward movement of the tubing T by reason of the obstruction which the operator can observe on the gauge 82. Also, there may even be an upward force exerted at the base 12 which would be indicated on the gauge 80. Thus, by the two gauges 80, 82, an operator at the surface can readily determine that there is an obstruction and the extent of it.

FIG. 3B illustrates the relative positions of the load cell apparatus when an upward force is exerted on the base 12 by the tubing T. When the base 12 moves upwardly, the tubular guide 30 also moves upwardly and it moves the actuating member 70 upwardly, which in turn moves the upper piston 55 upwardly. Such upward movement of the piston 55 applies a compressive force to the liquid in the fluid pressure chamber 50*a*, the amount of which is in response to and representative of the amount of upward force on the tubing T. Such fluid pressure is indicated at the gauge 80 (FIG. 2).

It should be noted that when the piston 60 moves downwardly, the piston 55 remains in its neutral position because it is stopped from any downward movement by the stop ring 75. Similarly, when the force or load on the tubing T is in an upward direction, and the piston 55 moves upwardly as shown in FIG. 3B, the stop ring 75 prevents any upward movement of the lower piston 60. By reason of such construction, the gauges 80 and 82 provide independent readings because of the independent movement of the pistons 55 and 60, regardless of the direction of movement or load on the tubing T.

Figure 4:
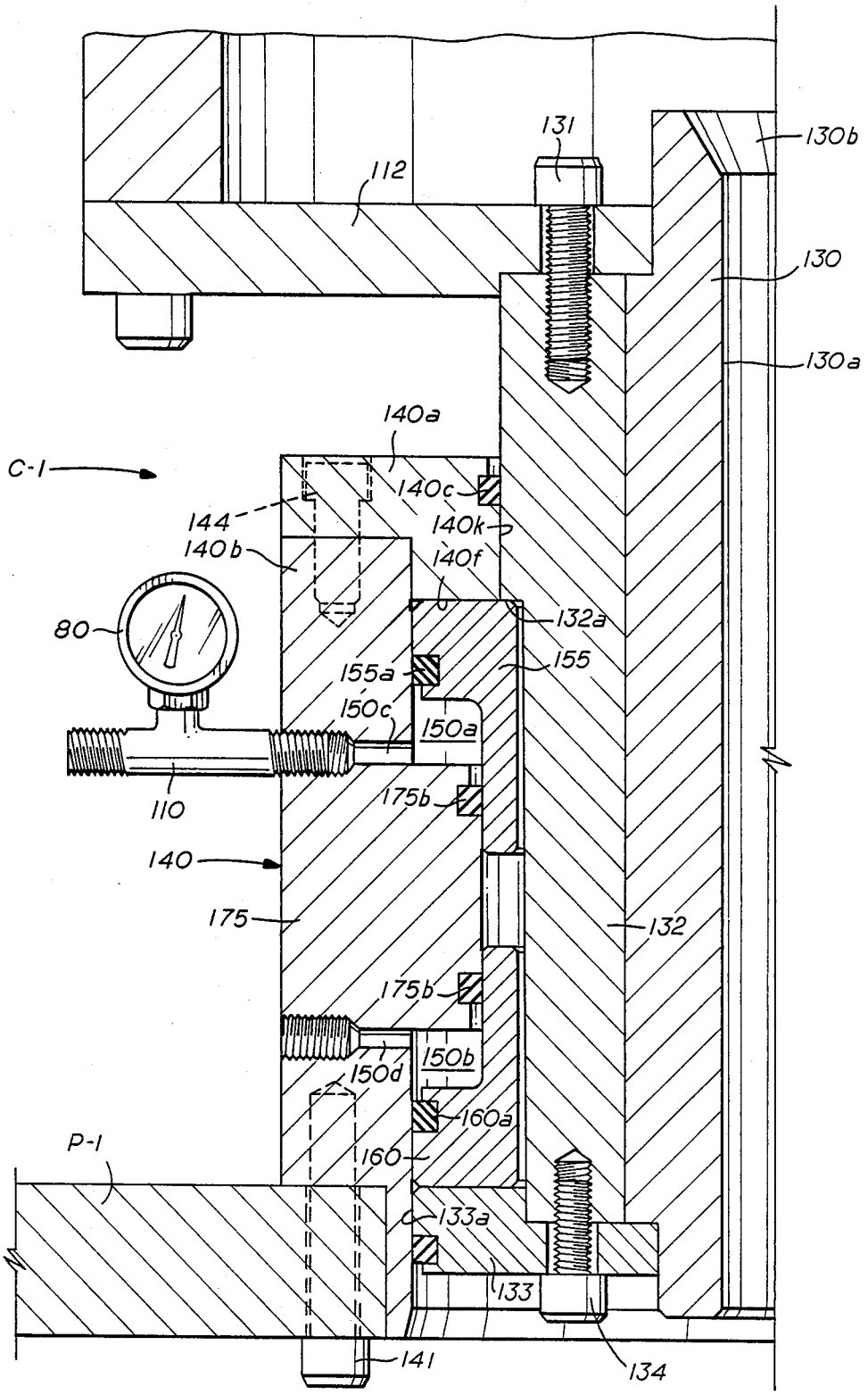
FIG. 4 is a view partly in section and partly in elevation, illustrating another embodiment of the load cell apparatus of the present invention when the tubing is not imparting a load of force in either direction on the apparatus.

Referring now to FIG. 4, another embodiment of the invention is illustrated, with the parts of FIG. 4 which correspond to the parts of FIG. 3 having the prefix "1" before the identifying numerals. Thus the base 112 is connected to the injector apparatus A. The load cell apparatus C-1 of FIG. 4 is disposed between such base 112 and the platform P-1. The tubular guide is formed of two parts, an inner tubular guide member 130 and an outer tubular guide member 132, rather than being a single member such as 30 in FIG. 3. By means of a lower annular plate 133, bolts 134, and 131, the guide members 130 and 132 are connected to the base 112 and are movable longitudinally therewith.

The diameter of the inner surface 130*a* of the inner tubular guide member 130 is large enough for the tubing T to move freely through the member 130, but the annular spacing of such inner surface 130*a* from the tubing is close enough to serve as a guide for the tubing as it moves substantially vertically into and out of the well, and additionally to provide lateral support for the tubing T to prevent it from buckling if an obstruction is encountered by the tubing T when moving into the well. Further, the member 130 may be interchangeable with other guide members having smaller or larger diameters of the inner surface 130*a* to provide the foregoing features for tubing of different external diameters. The upper end 130*b* of the guide member 130 is tapered to facilitate the initial movement of the lower end of the tubing T into the guide member 130.

The fluid pressure housing 140 is formed by a cylinder 140*b* and an upper annular plate 140*a*. Bolts 141 and 144 secure the housing sections 140*a* and 140*b* together and also to the platform P-1. A fluid pressure chamber is provided between the guide cylinder 132 and the housing 140. Such chamber has an upper fluid pressure section 150*a* and a lower fluid pressure section 150*b*. An annular inwardly extending ring 175 which is preferably an integral part of the cylinder 140*b* separates the chamber 150*a* and 150*b*. Such separator 175 has suitable seals such as O-rings 175*b* which seal with the external surfaces of upper piston 155 and lower piston 160. The upper piston has an O-ring or other seal 155*a* and the lower piston 160 has an O-ring or other seal 160*a* for sealing with the inside annular surface of the housing 140*b*. Also, a seal 140*c* is provided to close off the upper end of the fluid pressure chamber and a seal 140*d* closes off the lower end of the fluid pressure chamber.

The external surface of the guide member 132 has an annular lateral shoulder 132*a* which is in alignment with annular surface 140*f* and which surfaces engage the upper surface of the piston 155 when the piston 155 is in the upper position shown in FIG. 4. The shoulder 132*a* engages the piston 155 to transmit downward movements of the guide 130, 132 to the piston 155, as will be explained.

FIG. 4 illustrates the modified load cell C-1 in the neutral position when the tubing T is not exerting a force in either direction on the base 112. Preferably, the upper annular chamber 150*a* is connected to a liquid pump (not shown) by means of a T-shaped connector 110 extending from the outlet 150*c*, and which has gauge 80 therewith. In the preferred embodiment, the liquid in the chamber 150*a* is pressured up by the pump just enough to apply a lifting force to the base 112 and the portion of the apparatus A which is supported thereon so as to offset the weight of such apparatus, thus making it weightless as if floating on the liquid in the upper chamber 150*a*. Because of such floating arrangement, the variations which appear on the guages 80, 82 are more accurate indications of the weight of the tubing T which is supported by the apparatus A.

Figure 4A:
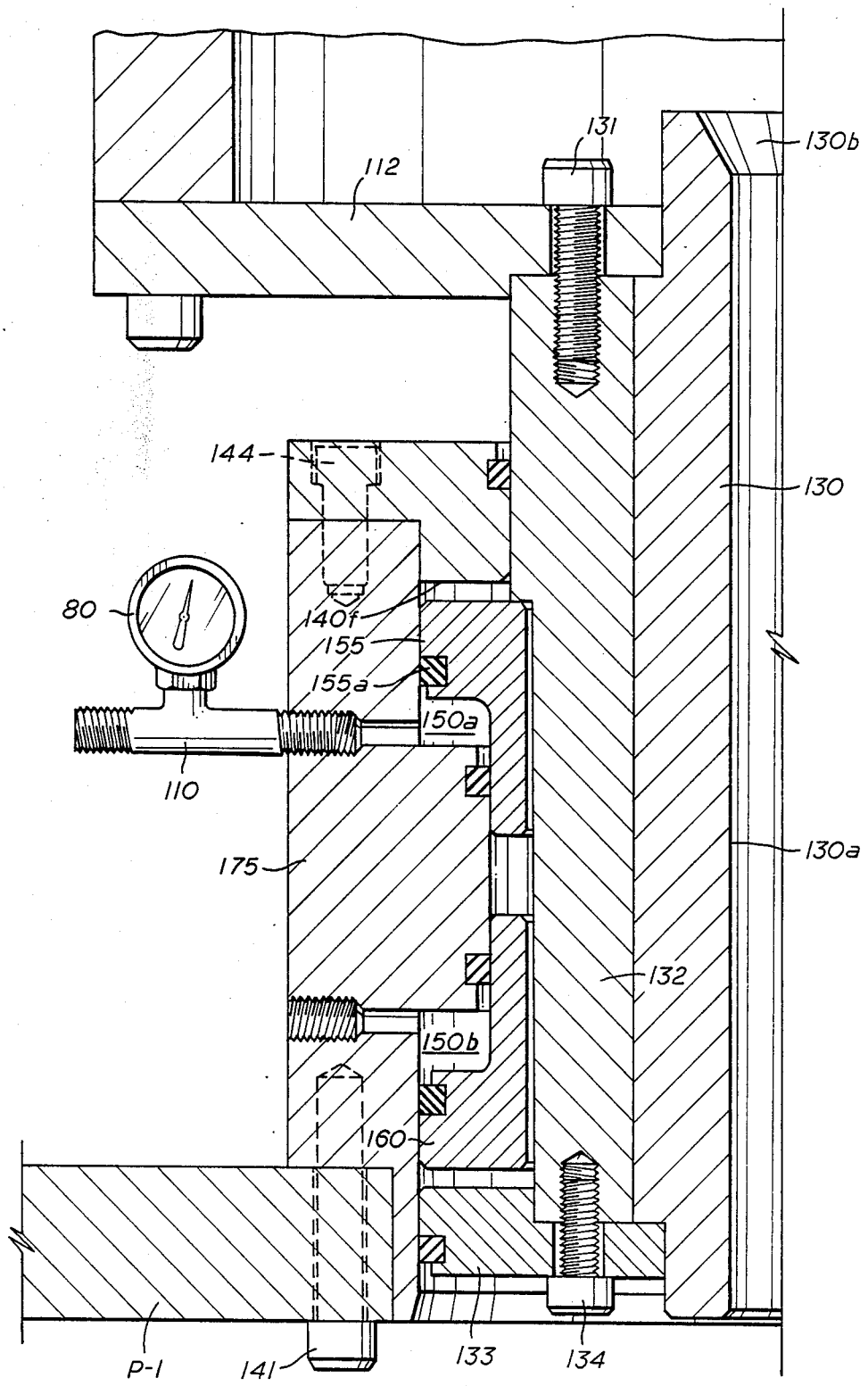
FIG. 4A is a view similar to FIG. 4, but showing the load cell apparatus with a load applied to the load cell apparatus by the tubing as it is injected downwardly into the well.

When a downward force is exerted by the tubing T, the piston 155 is moved downwardly to apply compressive force on the liquid in the fluid pressure chamber section 150*a*. Such increase in pressure is transmitted through the opening 150*c* which is connected to a gauge such as gauge 80. It is to be noted that the piston 160 does not move downwardly when the piston 155 moves downwardly since they are operable and movable independently of each other. Any tendency of the piston 160 to move downwardly would tend to create a vacuum which would hold it in its position as illustrated in FIG. 4A. Also, it will be understood that the amount of movement of the piston 155 illustrated in FIG. 4A is exaggerated for purposes of illustration.

Figure 4B:
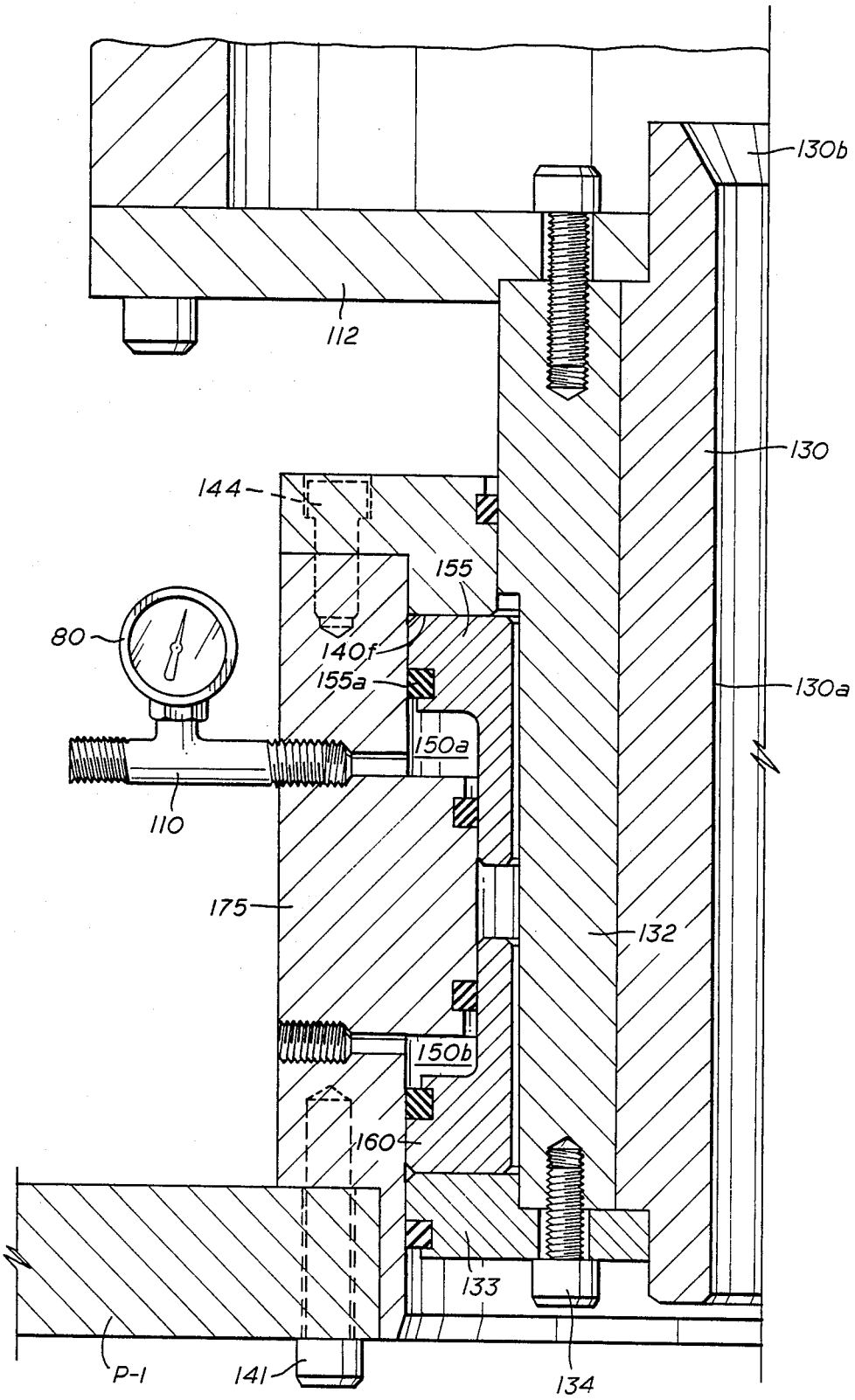
FIG. 4B is a view similar to FIG. 4, but showing the load cell apparatus when the tubing is exerting a load or force in the upward direction.

Referring now to FIG. 4B, the apparatus is shown in a position wherein the tubing T is exerting an upward longitudinal force on the base 112. Such upward force causes the lower piston 160 to be moved upward by the upward movement of the guide members 130 and 132, as will as the lower plate 133. The fluid in the fluid pressure chamber 150*b* is compressed in response to the amount of force in the upward direction on the tubing T and the increased pressure is indicated through a port 150*d* connected to the lower gauge such as 82 (shown in FIG. 2).

An intrinsic feature of this invention in both of the embodiments illustrated and described above, is that during the filling of the fluid chambers, both pistons are compelled to move away from each other (FIG. 4) or towards each other (FIG. 3) and they come to rest against the shouldered parts of the movable member (130, 132 in FIG. 4 and 30 in FIG. 3), thereby ensuring intimate contact with no slack in the movements of the pistons, regardless of the manufacturing tolerances. Removal of slack or gaps in the system is valuable since working travel of the movable pistons is measured in very small increments. Thus, the present invention provides for a high degree of accuracy in the weight indications on the gauges 80, 82.

Further, because the two chambers are divided by an impermeable barrier such as 174 in FIG. 4, communication between the two chambers is prevented and therefore separate fluid or pressure signals are reflected on the gauges 80 and 82. Each of the pistons is free to move independently of the other piston and neither is attached to the movable member such as 130, 132 in FIG. 4 and 30 in FIG. 3. Of prime importance is the fact that, only in the neutral position, i.e., when no load is placed on the load cell in either direction by the tubing T, does the movable member (130, 132 in FIG. 4 and 30 in FIG. 3) contact both pistons simultaneously. The moment that the movable member moves, it loses contact with one piston but remains in contact with the opposite piston. It is for this reason that the chambers 150*a* and 150*b* are never subjected to a vacuum-causing load and the error producing suction drag which would be present in a single piston structure, never exists in the present invention.

Another feature of the present invention resides in the concentric location of the tubing string T with respect to the axis of the well in which the tubing T is being lowered or raised. The structure of this invention facilitates such concentric location of the tubing string by the use of the bolts such as 131 which connect the base 112 to the load cell C-1 as shown in FIG. 4.

Further, gross angular displacement of the apparatus A with respect to the axis of the well is effectively eliminated by the provisional load bearing members within the load cell C-1. Thus, in FIG. 4, the inside annular surface 140*k* engages the external surface of the cylinder 132, and the external annular surface 133*a* of the lower plate 133 engages the internal surface of the member 140. Since the member 140 is secured to the platform P-1 and the member 132 is secured to the base 112, the apparatus A supported on the base 112 is thereby prevented from any significant angular displacement from a vertical position. The same advantages are present in the form of the invention shown in FIG. 3.

Although the invention has been disclosed for use with well tubing which is disposed in a vertical or substantially vertical position, it should be understood that the load cells disclosed herein may be used in directions other than vertical and with equipment other than tubing strings.

The foregoing disclosure and description of the invention are illustrative and explanatory thereof, and various changes in the size, shape and materials, as well as in the details of the illustrated construction may be made without departing from the spirit of the invention.

We claim:

1. Apparatus for detecting and indicating loads on an elongate object disposed for movement relative to the apparatus comprising:

a load cell housing having a longitudinally extending central portion;

a tubular guide positioned in said central portion of said housing for limited longitudinal movement relative to said housing;

a load cell chamber between said housing and said tubular guide;

a first piston extending into said chamber and adapted for longitudinal movement relative to said housing;

a second piston extending into said chamber and longitudinally spaced from said first piston and adapted for longitudinal movement relative to said housing;

said load cell chamber having a sealed first chamber section adjacent said first piston with fluid therein which is adapted to be compressed by longitudinal movement of said first piston relative to said housing;

said load cell chamber also having a sealed second chamber section adjacent said second piston with fluid therein which is adapted to be compressed by longitudinal movement of said second piston relative to said housing;

means for imparting longitudinal movements of said tubular guide to one of said pistons independently of the other of said pistons to develop a pressure on the fluid in one of said chamber sections which is indicative of the amount of longitudinal force on said tubular guide; and indicator means associated with each of said chamber sections for indicating the amount of force on said tubular guide.

2. The apparatus of claim 1, including:

means for imparting longitudinal movements of said tubular guide to said other of said pistons independently of said one of said pistons to develop a pressure on the fluid in the other of said chamber sections which reflects the amount of longitudinal force on said tubular guide.

3. The apparatus of claim 1, wherein:

said one of said pistons is an upper piston.

4. The apparatus of claim 1, wherein:

said one of said pistons is a lower piston.

5. The apparatus of claim 2, wherein:

said other of said pistons is a lower piston.

6. The apparatus of claim 2, wherein:

said other of said pistons is an upper piston.

7. A load cell apparatus for detecting and indicating loads on tubing wherein the tubing is injected or withdrawn into or out of a well by a tubing injector apparatus, comprising:

a tubular load cell housing disposed directly below said tubing injector apparatus with its longitudinal center in longitudinal alignment with the tubing in the injector apparatus;

a tubular guide disposed in said load Cell housing and connected to said tubing injector apparatus for longitudinal movement with said injector apparatus relative to said housing, and through which the tubing moves into and out of the well;

an annular sealed chamber having a first chamber section an a second chamber section between said tubular housing and said tubular guide and having fluid therein;

a first annular piston disposed in said first chamber section for longitudinal movement with said tubular guide in one longitudinal direction for developing a fluid pressure in said first chamber section which is indicative of the amount of force exerted by the tubing in said one longitudinal direction;

a second annular piston disposed in said second chamber section longitudinally spaced from said first piston for longitudinal movement with said tubular guide in the opposite longitudinal direction from said one longitudinal direction for developing a fluid pressure in said second chamber section which is indicative of the amount of the force exerted by the tubing in said opposite longitudinal direction; and a separate indicator means connected to each of said first chamber section and said second chamber section for indicating the amount of load exerted by the tubing in each longitudinal direction.

8. The apparatus of claim 7, including:

means for moving said first annular piston and said second annular piston independently of each other.

9. The apparatus of claim 7, wherein:

the fluid pressure within said first chamber section is pressurized sufficiently to offset the weight of the tubing injector apparatus to thereby provide neutral buoyancy to the injector head.

10. The apparatus of claim 7, including:

lateral load-bearing means for resisting lateral loads on the tubing injector to thereby maintain the tubing concentrically with respect to said tubular guide and for minimizing annular deviations of the tubing from the longitudinal axis of the well.

11. The apparatus of claim 7, wherein:

said tubular guide has an internal diameter which is larger than the external diameter of the tubing but which is sufficiently close to the external diameter of the tubing to prevent buckling of the tubing if the tubing encounters an obstruction which inhibits its downward movement in the well.

12. The apparatus of claim 7, including:

means for ensuring that there is no lost motion of either of said pistons as each moves in response to the fluid pressure changes in the respective chambers.

* * * * *